United States Patent [19]

Marangoni et al.

[11] 4,106,127

[45] Aug. 15, 1978

[54] ENERGY ABSORBING SUSPENSION ELEMENT

[75] Inventors: Roy D. Marangoni, Pittsburgh; Harry W. Austin, Monroeville, both of Pa.

[73] Assignee: Mine Safety Appliances Company, Pittsburgh, Pa.

[21] Appl. No.: 699,998

[22] Filed: Jun. 25, 1976

[51] Int. Cl.[2] ..... A42B 3/02

[52] U.S. Cl. ..... 2/416

[58] Field of Search ..... 2/416, 417, 418, 419, 2/420, 6, 10, 411; 297/386; 188/1 C

[56] References Cited

U.S. PATENT DOCUMENTS

| | | | |
|---|---|---|---|
| 2,400,077 | 5/1946 | Dauster | 2/416 X |
| 2,758,305 | 8/1956 | Gross | 2/416 |
| 2,910,702 | 11/1959 | Austin et al. | 2/416 X |
| 2,921,318 | 1/1960 | Voss et al. | 2/416 X |
| 2,946,063 | 7/1960 | Boyer | 2/418 |
| 3,237,201 | 3/1966 | Morgan | 2/416 X |
| 3,430,260 | 3/1969 | Johnson et al. | 2/416 |
| 3,938,627 | 2/1976 | Nagazumi | 297/386 X |

*Primary Examiner*—Peter Nerbun

*Attorney, Agent, or Firm*—Brown, Murray, Flick & Peckham

[57] ABSTRACT

A suspension element for suspending a load and absorbing energy if the load is increased suddenly above a predetermined minimum includes a normally rigid ring that is permanently deformable under an applied load above said minimum. Diametrically opposite areas of the ring are connected to a support and a load, but the opposite sides of the ring between those areas are free of the connecting means and subject to being pulled toward each other if the load suspended by the ring suddenly increases beyond the predetermined miminum and elongates the ring in the direction of the movement of the load. The energy required to thus deform the ring is absorbed by the ring.

3 Claims, 4 Drawing Figures

ENERGY ABSORBING SUSPENSION ELEMENT

A common protective industrial head gear is composed of a rigid shell that fits over the head and that contains a cradle resting on the head and supporting the shell with its upper portion spaced above the head. When the rigid helmet shell is struck by a downwardly directed blow, the forces developed are transmitted to the cradle at its points of connection to the shell around its bottom. Since the cradle is made up of flexible straps, only tensile forces are developed in them and if they are made from a molded plastic, they may be stretched permanently by the impact and thus absorb the impact energy. The properties of plastic straps can vary considerably during this type of dynamic stressing and the straps may become very brittle, especially when the helmet temperature is below room temperature. When the straps become brittle they can neither absorb nor dissipate energy effectively, but become very stiff or go into uncontrolled plastic deformation, or rupture in a brittle fashion. As can be seen, one of the major disadvantages of such a suspension cradle is that it absorbs and dissipates energy only by means of tensile stressing, which is not as controlled and efficient a manner as desired. The same problem exists when such straps are used in other areas where an energy absorbing device is required, such as safety belt securing lines for window cleaners and the like.

It is among the objects of this invention to provide an energy absorbing suspension element or system, which involves bending as well as stretching, which is more reliable than heretofore, and which is simple and inexpensive in construction.

The preferred embodiment of the invention is illustrated in the accompanying drawings, in which FIG. 1 is a vertical section through a protective helmet;

Figure 1:
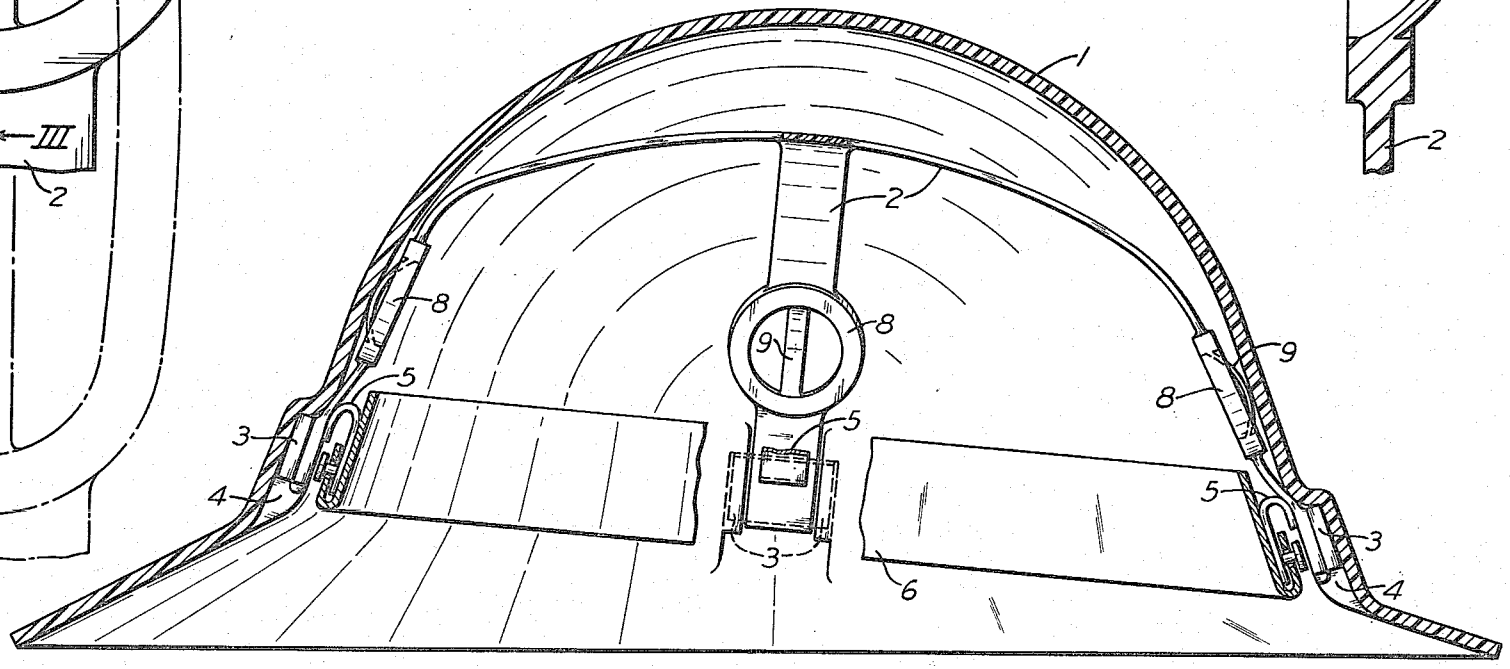

Referring to FIG. 1 of the drawings, a protective helmet of any desired shape has a rigid shell 1 that fits over the head. To space the crown of the shell from the head, there is a suspension cradle that receives a head and that is formed from flexible straps 2 that extend over the head on which they rest. The lower ends of the straps are connected to the helmet shell in any suitable manner, such as by lugs 3 projecting from opposite sides of each strap and retained in sockets 4 in the lower part of the shell near its brim. Directly above the lugs, clips 5 are attached to the straps in any suitable manner and support a headband 6. The straps do not extend continuously from one side of the helmet to the other, but are separated into upper and lower sections by means of energy absorbing suspension elements.

Each of these elements includes a normally rigid ring 8, diametrically opposite areas of which are connected to the upper and lower strap sections. The diameter of each ring is greater than the width of the straps. Preferably, the rings are round, but they can be any other shape that is desired. Likewise, the cross sectional area of each ring can be any desired shape. The material of which the rings is made must not be brittle, but it must resist deforming by bending and stretching until a predetermined load for which the rings are designed is exceeded. Thus, the rings may be made from metal or from a molded synthetic plastic. Among the plastics, polyethylene is preferred, although polyurethanes, PMMA, polycarbonates, nylon and others can be used. For use in a protective helmet, plastic is preferred because it is light in weight and dielectric. For other applications, such as window cleaners' suspension harness and safety lines for construction workers, metal rings can be used. The strap sections can be attached to a ring by looping them through it. On the other hand, if the straps and rings are formed of the same plastic, the straps can be integral with the rings as shown. Also, the straps and lugs 3 can be molded in one piece, as shown in FIG. 1.

Figure 2:
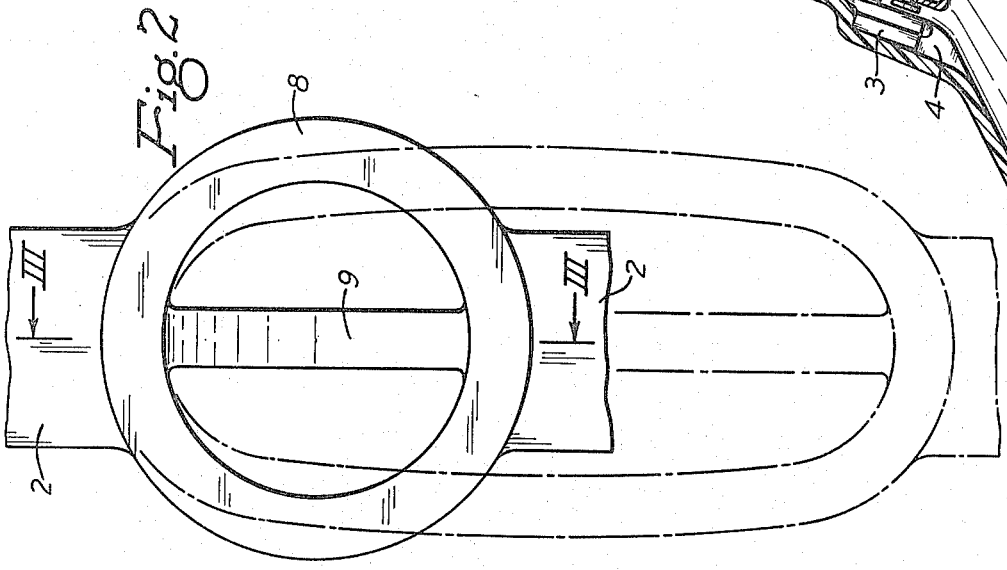
FIG. 2 is an enlarged fragmentary elevation of one of the suspension elements.

Many impacts received by the helmet shown in the drawings will not affect the suspension system because the impact forces will not be great enough. However, if those forces exceed the loading for which the suspension system has been designed, the cradle will absorb some or all of the excess energy. Thus, when the helmet is subjected to an impact that increases the load on it above the predetermined minimum, the lower strap sections will pull downwardly on the rings with sufficient force to bend and elongate the rings by pulling their opposite sides toward each other as shown in dotted lines in FIG. 2. During this bending and straightening of the opposite sides of the ring, its inner surface is placed under tension while its outer surface is subjected to compressive forces. Halfway between the inner and outer surfaces of the rings there is a neutral point, with the tensile forces increasing from that point toward the inside of the ring and the compressive forces increasing from the neutral point toward the outside of the ring. In other words, since bending stresses are predominant at this time, the inner surfaces of the opposite sides of the ring experience tensile stresses that decrease linearly to zero at the neutral axis and become gradually increasing compressive stresses from there out.

Upon continued loading, the tensile forces at the inner surfaces continue to increase until the yield point of the material is reached. At this time, only the innermost fibers of the ring have reached the yield stress, while the remainder of the ring structure is still behaving elastically. If the loading continues still further, the total area of plastically yielded and deformed material increases in a linear but controlled fashion. This is contrary to the total uniform tensile stressing that occurs in a plastically deformable suspension strap.

Total yielding of the complete cross section at each side of the ring occurs only after large deformation of the ring has occurred so that its sides are almost straight parallel sections of the ring. The yield stress and its progressive rate to total plastic deformation of the ring is governed by the material of which the ring is formed, the inside and outside diameters of the ring and its cross sectional area.

Although not absolutely necessary in all cases, it is preferred to provide each ring with a slack tension member 9 aligned with the adjoining strap sections. The opposite ends of this tension member are secured to the ring at diametrically opposite points. With a molded plastic ring, the tension member can be an integral part of the structure. Such a tension member will either limit stretching of the ring under load or it will help the ring to resist further stretching after the tension member has been pulled taut by the elongating ring.

Figure 3:
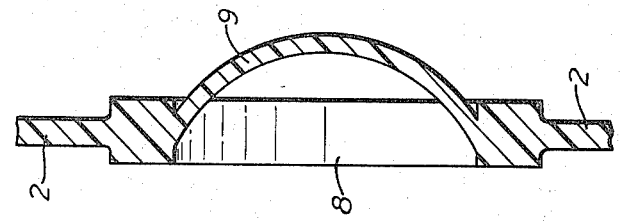
FIG. 3 is a cross section taken on the line III-III of FIG. 2.
Figure 4:
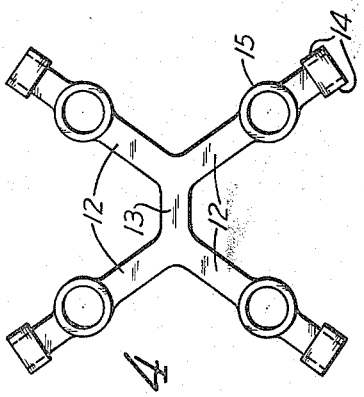
FIG. 4 is a plan view of a modification of the suspension system shown flat.

Instead of having the straps 2 extend lengthwise and crosswise of the helmet as shown in FIG. 1, similar straps 12, molded from a plastic, can extend somewhat diagonally relative to one another as shown in FIG. 4, with the inner or upper ends of the straps integrally connected by a short piece 13 extending lengthwise of the helmet. The outer or lower ends of the straps can be provided with integral lugs 14 for attachment to a helmet shell in the same way as the first embodiment. A shock absorbing ring 15 is included in each strap.

The invention disclosed herein provides an energy absorbing system that is more effective at both room temperature and cold temperatures than such systems known before.

According to the provisions of the patent statutes, we have explained the principle of our invention and have illustrated and described what we now consider to represent its best embodiment. However, we desire to have it understood that, within the scope of the appended claims, the invention may be practiced otherwise than as specifically illustrated and described.

We claim:

1. A suspension element for suspending a load and absorbing energy of the load is increased above a predetermined minimum, comprising a normally rigid molded nonbrittle plastic ring and means for connecting only two diametrically opposite areas of the ring to a support and a load, the ring being permanently deformable under an applied load above said minimum, the opposite sides of the ring between said two areas being free of any connecting means and bulging away from each other and said connecting means, and said bulging opposite sides of the ring being subject to being pulled toward each other permanently and straightened if the load suspended by the ring increases beyond said predetermined minimum and reduces the width of the ring by elongating the ring in the direction of the load, whereby the energy required to thus deform the ring is absorbed by the ring.

2. A suspension element according to claim 1, said load being a rigid helmet shell and said support being a flexible cradle in the helmet shell for seating on the head of the wearer of the helmet.

3. A suspension element according to claim 1, in which there is a plurality of said rings, said load being a rigid helmet shell and said connecting means including upper and lower straps secured to the rings, the outer diameter of the rings being greater than the width of the straps, and suspension elements for attaching the lower straps to the helmet shell at circumferentially spaced points, said support being a flexible cradle in the helmet shell and including the upper straps for seating on the head of the wearer of the helmet.

* * * * *